United States Patent [19]

Lechler et al.

[11] 4,274,815

[45] Jun. 23, 1981

[54] ROTARY COMBUSTION ENGINE OF TROCHOID DESIGN WITH OIL RETURN GROOVE

[75] Inventors: Rolf Lechler, Neckarsulm; Wulf Leitermann, Bad Wimpfen, both of Fed. Rep. of Germany

[73] Assignee: Audi Nsu Auto Union Aktiengesellschaft, Neckarsulm, Fed. Rep. of Germany

[21] Appl. No.: 33,795

[22] Filed: Apr. 26, 1979

[30] Foreign Application Priority Data

May 5, 1978 [DE] Fed. Rep. of Germany ..... 2819664

[51] Int. Cl.[3] ..... F01C 1/00; F01C 19/12; F01C 21/06

[52] U.S. Cl. ..... 418/91; 418/104; 418/142

[58] Field of Search ..... 418/91, 94, 104, 142

[56] References Cited

U.S. PATENT DOCUMENTS

| | | | |
|---|---|---|---|
| 3,165,259 | 1/1965 | Muller et al. | 418/142 |
| 3,168,237 | 2/1965 | Paschke | 418/142 |

FOREIGN PATENT DOCUMENTS

| | | | |
|---|---|---|---|
| 1299645 | 7/1969 | Fed. Rep. of Germany | 418/104 |
| 2305374 | 8/1974 | Fed. Rep. of Germany | 418/104 |
| 2432274 | 1/1976 | Fed. Rep. of Germany | 418/104 |

*Primary Examiner*—John J. Vrablik

*Attorney, Agent, or Firm*—Kane, Dalsimer, Kane, Sullivan & Kurucz

[57] ABSTRACT

A rotary combustion engine of trochoid design. The engine includes a housing composed of a jacket having a multicurved inner jacket face and two parallel side walls and a substantially horizontally disposed eccentric shaft which extends through circular apertures in the side walls. A liquid cooled piston is rotatably mounted on the eccentric. Oil control rings are mounted on the piston end walls which coact with the side faces of the side wall. A disk is provided in at least one piston end wall with a hub which rotates with the eccentric shaft concentrically with respect to the rotational axis of the piston and extends into the aperture of the side wall. The disk and the hub are provided with sealing rings in tight sealing engagement with the piston end wall and the wall of the aperture, respectively. The sealing rings encompass an annular chamber which is limited radially outwardly by the oil control ring. A groove is provided in the lower range of the wall of the aperture which receives the hub of the disk. This groove is coupled at its lowermost point with a return line by means of a bore.

2 Claims, 2 Drawing Figures

ROTARY COMBUSTION ENGINE OF TROCHOID DESIGN WITH OIL RETURN GROOVE

BACKGROUND OF THE INVENTION

The invention relates to rotary combustion engine of trochoid design. It includes a housing composed of a jacket having a multi-curved inner jacket face and two parallel side walls and a substantially horizontally disposed eccentric shaft which extends through circular apertures in the side walls. A liquid cooled piston is rotatably mounted on the eccentric. Oil control rings are mounted on the piston end walls which coact with the sidewalls of the side walls. A disk is provided in at least one piston end wall, said disk rotates with the eccentric shaft concentrically with respect to the rotational axis of the piston and has a hub which extends into the aperture of the adjacent side wall. The hub and the disks are provided with sealing rings in tight sealing engagement with the piston end wall and the wall of the aperture, respectively. The sealing rings encompass an annular chamber which is limited radially outwardly by the oil control rings. Such a rotary combustion engine is described in German Pat. No. 14 51 809, for example.

In this known rotary combustion engine the sealing ring which is mounted between the disk and the piston end wall prevents overflowing of cooling or lubricating liquids from the piston into the working chamber. In order to bring the sealing rings, which are inserted in grooves, into sealing engagement and thereby sealing the liquid cooled piston to the outside, a so-called intermediary sealing pressure is generated within the annular chamber. This intermediary sealing pressure is created under the influence of pressure gas which enters into the annular chamber from the working chamber through the oil control rings during operation of the combustion engine. However, since the sealing ring cooperating with the piston end wall reliably seals only at the presence of the intermediary sealing pressure, cooling fluid may flow from the piston over the sealing ring into the annular chamber when the combustion engine is not in operation. It had been shown that the cooling or lubricating liquid which penetrates into the annular chamber remains therein when the combustion engine is again operated and therefore flows into the working chamber through the oil sealing rings, and uselessly combusts therein.

SUMMARY OF THE INVENTION

It is therefore an object of the invention to provide a rotary combustion engine of the aforementioned type, wherein the lubricant liquid which did flow into the annular chamber, when the combustion engine is not in operation, is again returned to the liquid cycle, thus preventing a useless combustion.

This object of the invention is obtained by providing a groove in the lower range of the wall of the aperture which receives the hub of the disk. This groove is coupled at its lowermost point with a return line by means of a bore. With this improvement, the lubricant liquid which penetrated into the annular chamber is fed into the groove by the rotation of the disk and is then returned through the bore to the liquid cycle, and is thereby used again. Thereby, a combustion of this lubricant liquid quantity with a corresponding unfavorable smoke development and the formation of combustion residues is substantially prevented and the lubricant consumption is considerably improved. The cross section of the bore is essentially so chosen that the lubricant liquid may flow freely through the bore and from the groove, or may be pressed therethrough by the intermediary sealing pressure, but on the other hand no reduction of the intermediary sealing pressure is possible in the annular chamber.

In order to facilitate the drain of the lubricant liquid via the groove into the bore in the side wall, and in order to prevent a squeeze flow of the lubricant liquid between the annular chamber on the groove, the hub of the disk may be provided with an annular groove at its outer circumference between the adjacent front face of the disk and the receiving groove for the sealing ring.

One embodiment of the invention will now be described in more detail in conjunction with the appended drawings.

DETAILED DESCRIPTION

Figure 1:
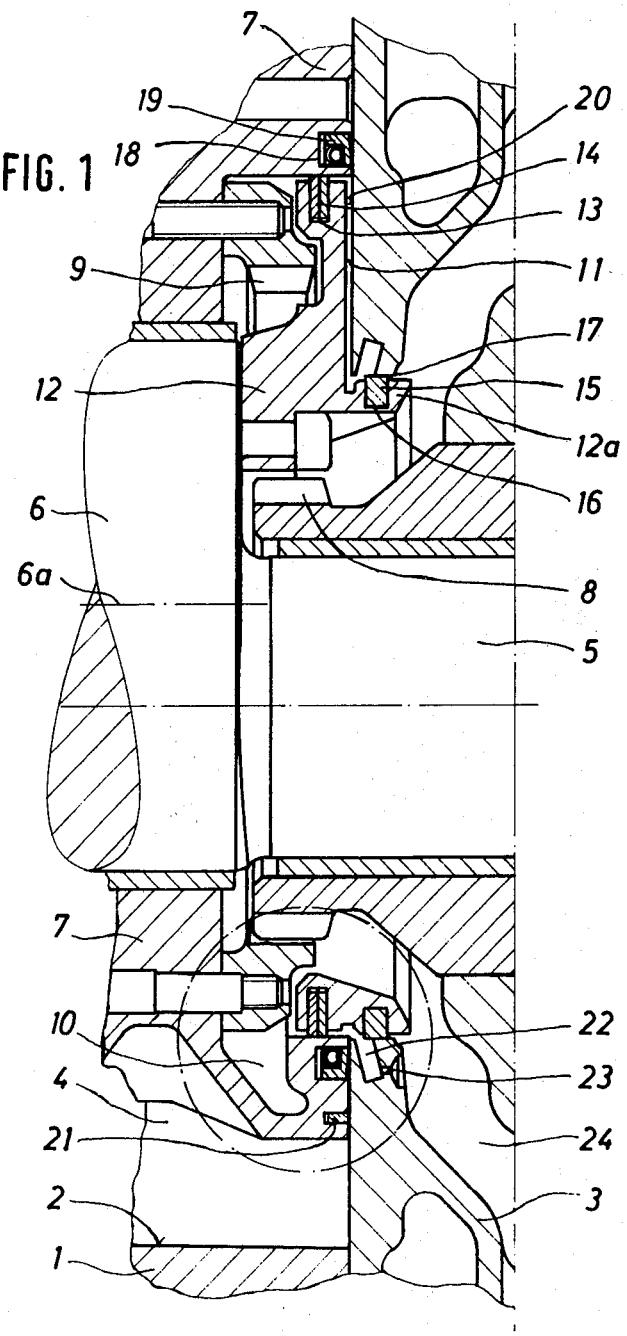
FIG. 1 shows a partial longitudinal sectional view of a rotary combustion engine of trochoid design.

The rotary combustion engine shown in FIG. 1 is provided with a housing which is composed of a jacket 1 having a double curved inner jacket face 2 and two parallel side walls 3 only one being shown encompassing a working chamber 4. A multicornered liquid cooled piston 7 is rotatably mounted on the eccentric 6 of eccentric shaft 5 and is positioned in working chamber 4 with shaft 5 passing axially through side walls 3. Piston 7 is in a defined ratio with respect to the rotational speed of excentric shaft 5 by means of a drive consisting of a pinion 8 which is coupled to side wall 3 and a hollow wheel 9 mounted in piston 7.

The drive is lubricated with a liquid which is also used for cooling piston 7 provided with a hollow chamber 10 for the passage of the cooling liquid therethrough.

In order to prevent a flowing of cooling liquid from the hollow chamber 10 of the piston into annular chamber 11 which is formed between piston 7 and side wall 3, a disk 12 is provided concentrically with respect to the rotational axis 6*a* of the piston. The disk 12 is mounted on eccentric 6. For example, disk 12 is provided in its circumferential groove 13 with two slotted outwardly tensioning sealing rings 14 which coact in sealing engagement with the piston end wall. Annular chamber 11 is sealed against side wall 3 with a sealing ring 15 which is inserted in a circumferential groove 16 of a pipe-like hub 12*a* of disk 12. Sealing ring 15 coacts with the circular aperture 17 of side wall 3 through which the substantially horizontally disposed eccentric shaft 5 extends. The annular chamber 11 is limited radially outwardly by an oil control ring 19 which is inserted into an axial annular groove 18 in the piston end wall, whereby the oil control ring is yieldingly and sealingly pressed against side wall 20 of side wall 3. For a lateral sealing of the working chamber 4, the piston front face is provided with radial and axial gas seals 21 which are mounted outside of the oil control ring 19 between piston 7 and side wall 3, whereby these gas seals are also pressed against the side face 20 of the side wall 3 in a yielding fashion.

The leaking gas which flows from the operating chamber 4 through gas seals 21 acts on the radial outwardly inclined front face of ring 19 thus pushing the oil control ring 19 away from the side face 20 and back into its annular groove. This action forms a leaking slot for the leaking gas to aid in building up a pressure cushion in annular chamber 11 limited by sealing rings 14 and 15 for a sliding and sealing engagement of sealing rings 14 and 15 during operation of the combustion engine. This so-called intermediary sealing pressure insures that the sealing rings 14 are pressed in sealing engagement against the corresponding groove flank of circumferential groove 13. This seal prevents cooling or lubricant liquid from flowing from the hollow chamber 10 through sealing ring 14 into annular chamber 11. Simultaneously, the sealing ring 15 is pushed by the intermediary sealing pressure in sealing and sliding engagement against its corresponding groove flank of circumferential groove 16.

Since the sealing engagement of sealing rings 14 in its circumferential groove 13 is practically only assured in the presence of an intermediary sealing pressure, cooling liquid can flow from the hollow chamber 10 through circumferential groove 13 or the joint of sealing ring 14 into annular chamber 11 when the combustion engine is not in operation. A flow of cooling liquid from the annular chamber 11 into working chamber 4 is prevented by the oil control ring 19 which radially limits annular chamber 11 to the outside, when the combustion engine is not in operation. In order to prevent the cooling liquid present in the annular chamber 11 from flowing into working chamber 4, after the combustion engine is started, an annular groove 22 is provided in the wall of aperture 17 of the side wall 3 between side wall 20 and the sealing ring 15 which engages the wall of aperture 17.

Figure 2:
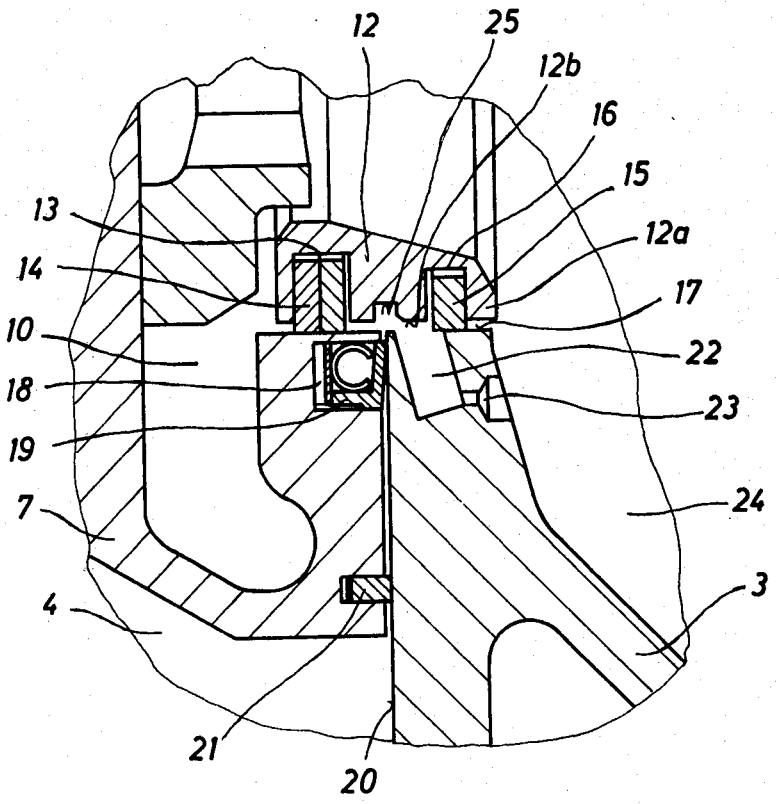
FIG. 2 shows the encircled area of FIG. 1 in an enlarged scale.

As can be seen in FIG. 2, at its lowermost point annular groove 22 is provided with a bore 23 which is coupled with a return line 24 of the lubricating or liquid cycle of the combustion engine. In the shown position, the cooling liquid which has accumulated in annular chamber 11 may flow out through this annular groove 22 and return through bore 23 into the lubricant liquid cycle. The intermediary sealing pressure which forms in annular chamber 11 after the combustion engine is started blows out any lubricant residues through bore 23, whereby bore 23 has a cross sectional area which substantially prevents a reduction of the intermediary sealing pressure. In the shown position, the gap between the outer circumference **12*b* of hub 12*a* and the wall of aperture 17 is relatively narrow and impedes the flow of lubricant liquid from annular chamber 11 to groove 22. In order to obtain a quick drain after the start of the engine and after the first few revolutions, in case that a large quantity of lubricant liquid has accumulated in the annular chamber 11 while the combustion engine is inoperative and which cannot completely flow out through annular groove 22 after the start of the engine and after the first few rotations, an annular relief groove 25 is provided in the outer circumference 12*b* of hub 12*a* between adjacent front face of disk 12 and the circumferential groove 16 of sealing ring 15**, so that the lubricant liquid can be completely pressed out.

In deviaton from the depicted embodiment, instead of the annular groove 22 a groove may be provided which extends merely in the lower range of the wall of aperture 17 which receives hub **12*a***.

The arrangement shown in the drawings for the right piston front face may be provided in principle for the left piston front face which is not shown.

Thus the several aforenoted objects and advantages are most effectively attained. Although several somewhat preferred embodiments have been disclosed and described in detail herein, it should be understood that this invention is in no sense limited thereby and its scope is to be determined by that of the appended claims.

We claim:

1. A rotary combustion engine of trochoid design comprising; a housing composed of a jacket having a multi-curved inner jacket face and two parallel side walls and a substantially horizontally disposed eccentric shaft which extends through circular apertures in the side walls, a liquid cooled piston rotatably mounted on the eccentric, oil control rings mounted on the piston end walls which coact with the sidefaces of the side walls, a disk provided in at least one piston end wall and rotating with the eccentric shaft concentrically with respect to the rotational axis of the piston and having a hub which extends into the aperture of the side wall, whereby the disk and the hub are provided with sealing rings in tight sealing engagement with the piston end wall and the wall of the aperture, respectively, the sealing rings sealing an annular chamber between said one piston end wall and the adjacent side wall which is limited radially outwardly by the oil control ring, a groove provided in the lower range of the wall of the aperture which receives the hub of the disk, whereby this groove is in communication with the annular chamber and is coupled at its lowermost point with a return line to the liquid cycle by means of a bore which will return liquid in the annular chamber at all times including when the engine is not in operation.

2. A rotating combustion engine in accordance with claim 1, wherein an annular like relief groove is provided in the outer circumference of the hub of the disk between the adjacent front face of the disk and the sealing ring on the hub.

* * * * *